United States Patent [19]

Jordan

[11] Patent Number: 4,469,060

[45] Date of Patent: Sep. 4, 1984

[54] GASTIGHT, UNDETACHABLE CONNECTION OF TWO METAL PARTS

[75] Inventor: Friedrich Jordan, Kürten, Fed. Rep. of Germany

[73] Assignee: Klöckner-Humboldt-Deutz Aktiengesellschaft, Cologne, Fed. Rep. of Germany

[21] Appl. No.: 329,003

[22] Filed: Dec. 9, 1981

[30] Foreign Application Priority Data

Dec. 12, 1980 [DE] Fed. Rep. of Germany ..... 3046776

[51] Int. Cl.[3] ..... F02F 1/00

[52] U.S. Cl. ..... 123/193 CH; 29/156.4 R; 123/41.69; 164/98; 164/108

[58] Field of Search ..... 123/193 R, 193 H, 193 C, 123/193 CH, 41.69; 29/156.4 R; 164/98, 108–110

[56] References Cited

U.S. PATENT DOCUMENTS

| | | | |
|---|---|---|---|
| 1,360,909 | 11/1920 | Fedden et al. | 123/41.69 |
| 3,166,053 | 1/1965 | Fischer et al. | 123/41.69 |

FOREIGN PATENT DOCUMENTS

| | | | |
|---|---|---|---|
| 361000 | 10/1922 | Fed. Rep. of Germany | 123/41.69 |
| 2747839 | 5/1978 | Fed. Rep. of Germany | 164/110 |
| 2911628 | 9/1980 | Fed. Rep. of Germany | 123/193 C |

*Primary Examiner*—Craig R. Feinberg

*Attorney, Agent, or Firm*—Becker & Becker, Inc.

[57] ABSTRACT

A positive, gastight, and undetachable connection of two metal parts, especially a cylinder head and a cylinder tube of an internal combustion engine. A groove is located in one of the two parts; this groove, together with a counterpiece of the second part, which counterpiece engages in the groove, forms an annular chamber which is filled with molten metal according to the die-cast method, and in such a way as to be free of occlusions.

4 Claims, 4 Drawing Figures

GASTIGHT, UNDETACHABLE CONNECTION OF TWO METAL PARTS

The present invention relates to a positive, gastight, undetachable connection of two metal parts, especially a cylinder head and a cylinder tube of an internal combustion engine.

The previously known connections of two metal parts, for instance by welding, adhesion, or screwing, can only be used to a limited extent, or with considerable difficulty, if the parts are made of different materials, for instance cylinder heads and cylinder tubes of internal combustion engines, where the cylinder heads are made of an aluminum cast alloy, and the cylinder tubes are made of a cast-iron alloy. Since the cylinder heads, because of their high heating and their material characteristics, expand much more than the cylinder tubes, satisfactory results cannot be obtained with the previous conventional types of connections.

The conventional types of connection also do not lead to satisfactory results even when identical materials are used with the selected example of the cylinder head—cylinder tube. For example, sealing problems arise with screw connections, and in addition, the nearly point-type or concentrated force introduction or application leads to inhomogeneous stress distribution in the structural parts. Welding methods are precluded for the conventional materials of cylinder heads and cylinder tubes, and the adhesive techniques are not applicable at all, or only to a limite extent, since the required thermal stability cannot be attained.

It is an object of the present invention to make possible a connection of metal parts, especially cylinder heads and cylinder tubes of an internal combustion engine, which connection takes into account the indicated problems, and which is simple and inexpensive to produce.

This object, and other objects and advantages of the present invention, will appear more clearly from the following specification in connection with the accompanying drawings, in which.

Figure 3:
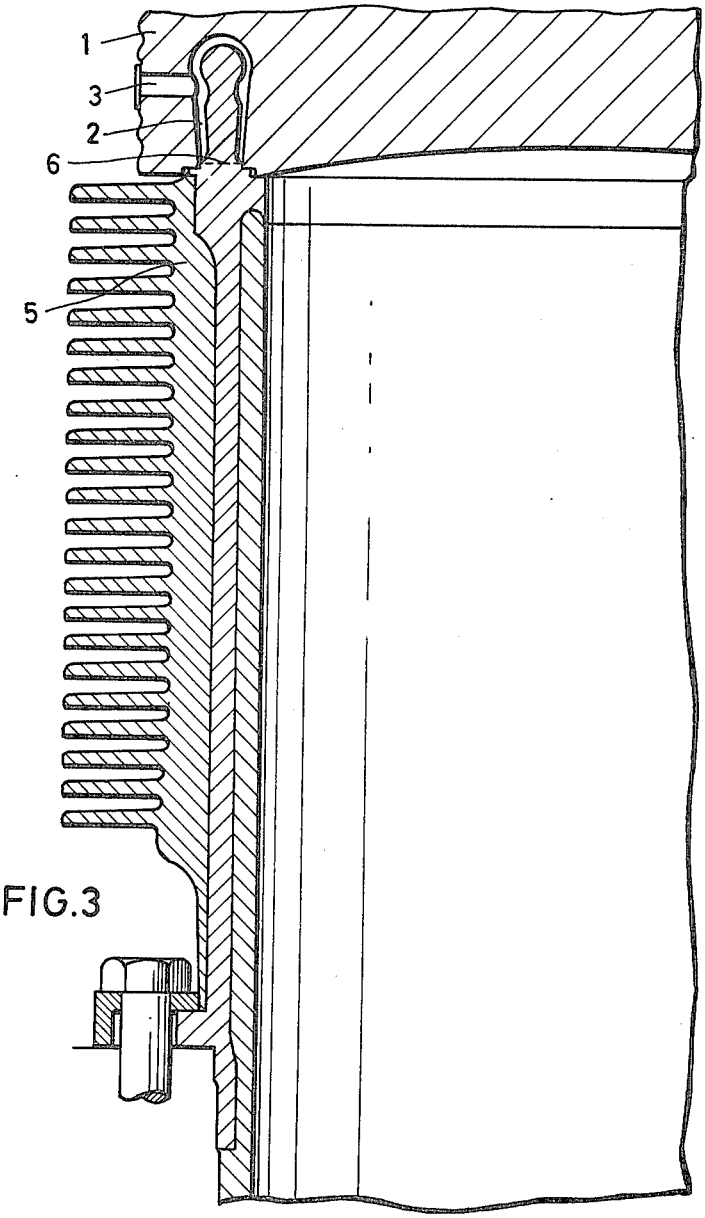
Figure 4:
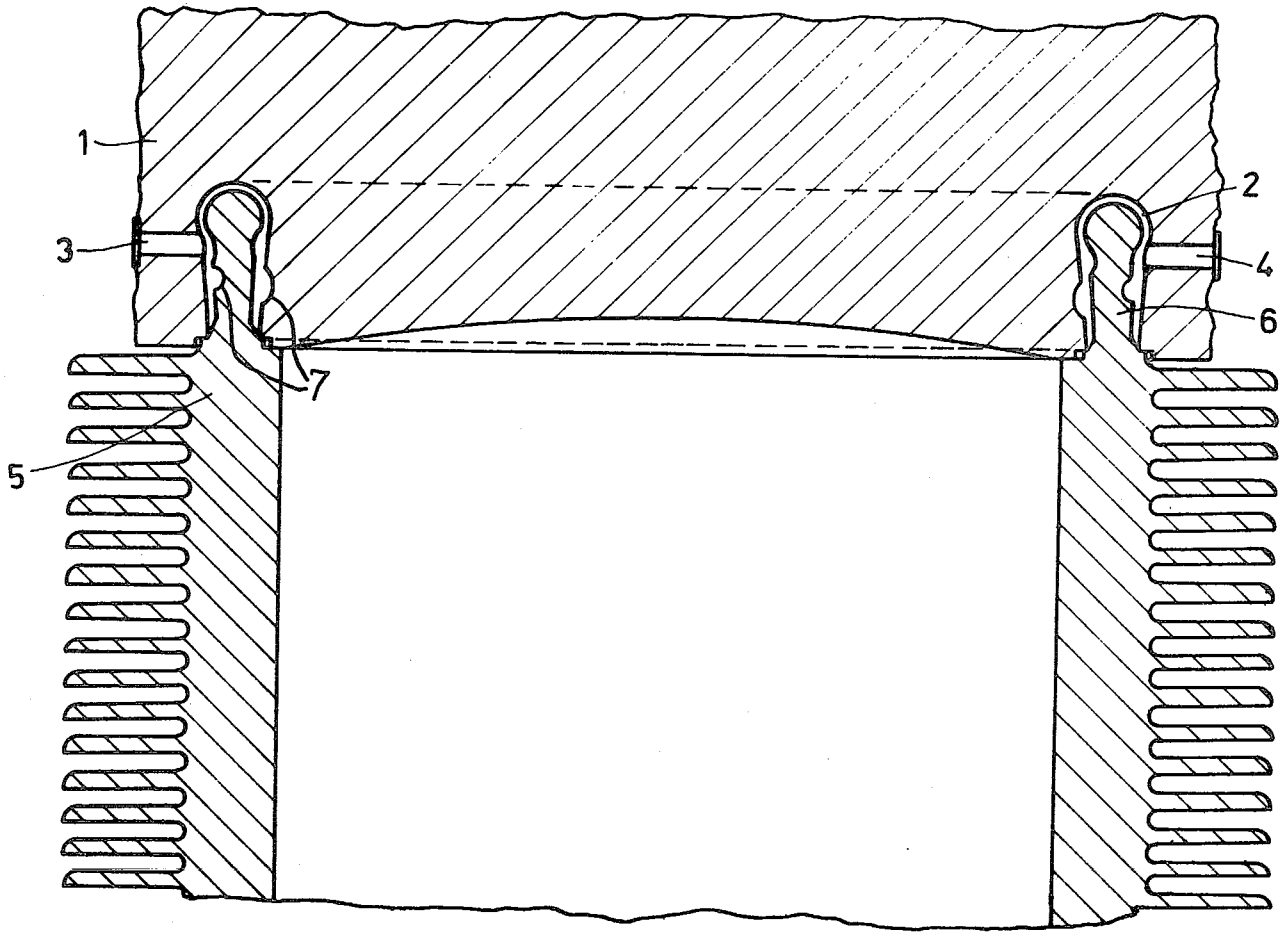

FIG. 3 shows yet another embodiment of a connection of a cylinder head and a cylinder tube, with the counterpiece which engages in the groove comprising a steel tubing which has a flange and is integrated in the cylinder tube; and FIG. 4 shows a further embodiment of a connection of a cylinder head and a cylinder tube, with one sidewall of each of the groove and the counterpiece being provided with respective grooving.

The connection of the present invention is characterized primarily in that a groove is located in one of the two parts; this groove, together with a counterpiece of the second part, which counterpiece engages in this groove, forms an annular chamber which is filled with molten metal according to the diecasting method, in such a way as to be free of occlusions. This inventive connection is gastight and undetachable, is distinguished by high strength, and, depending upon the die cast material utilized, offers a certain amount of elasticity, which compensates for the expansion differences between the parts. Depending upon the intended application of the parts to be connected, examples of diecast materials which can be used include zinc, aluminum, magnesium, copper alloys, gray or cast iron, spheroidal graphite iron, and steel. It is especially advantageous to utilize higher melting diecast materials, because then during the pouring procedure there results a metallic connection between the filler material and the parts to be connected.

According to a further embodiment of the present invention, it is proposed that the groove be embodied in such a way that it is wider at the base than at the opening, and that the counterpiece which engages in the groove be wider at the head than at the base thereof, with the head being just so wide that it can still be inserted into the groove. In so doing, the poured-in diecast material acts as an intermediate wedge, and a secure positive connection is attained. It is furthermore proposed that the groove have slanted or inclined sidewalls, that the base or bottom be circular, and that the counterpiece have identical inclined side walls with a circular head. This assures an occlusion-free pouring, since no sharp corners and edges are present on which dirt and gas bubbles can settle. Additionally, possible starting points for cracks or fissures are eliminated by the avoidance of sharp corners and edges; such cracks could otherwise occur with the great mechanical and thermal loads which act on the connection of the cylinder head and the cylinder tube of an internal combustion engine.

According to a further embodiment of the present invention, the groove and/or the counterpiece can be provided with projections, recesses, grooves, and the like in the inclined sidewalls, in order to thereby achieve a still better clamping or connection. With this type of connection, it is advantageous to provide at least one filling opening and one venting opening, respectively, which start from the formed annular chamber and extend outwardly; these openings are preferably diametrically arranged. During the pouring and trapping of the molten material, the parts to be connected are positioned in such a way that the venting opening lies vertically above the filling opening in order to achieve a complete filling.

According to yet another embodiment of the present invention, the counterpiece may be made in one piece or integral with the cylinder tube, or may comprise a tube or tubing which is cast into the cylinder tube.

Referring now to the drawings in detail, reference numeral 1 designates part of a cylinder head of an internal combustion engine, which is connected with a cylinder barrel or tube designated by the reference numeral 5, likewise only shown in part. A groove 2 is located in the cylinder head 1. In conjunction with a counterpiece 6, this groove forms an annular chamber which is filled with die cast metal. For this purpose, there are provided a filling opening designated with the reference numeal 3, and a venting opening, arranged diametrically thereto, designated with the reference numeral 4.

Figure 1:
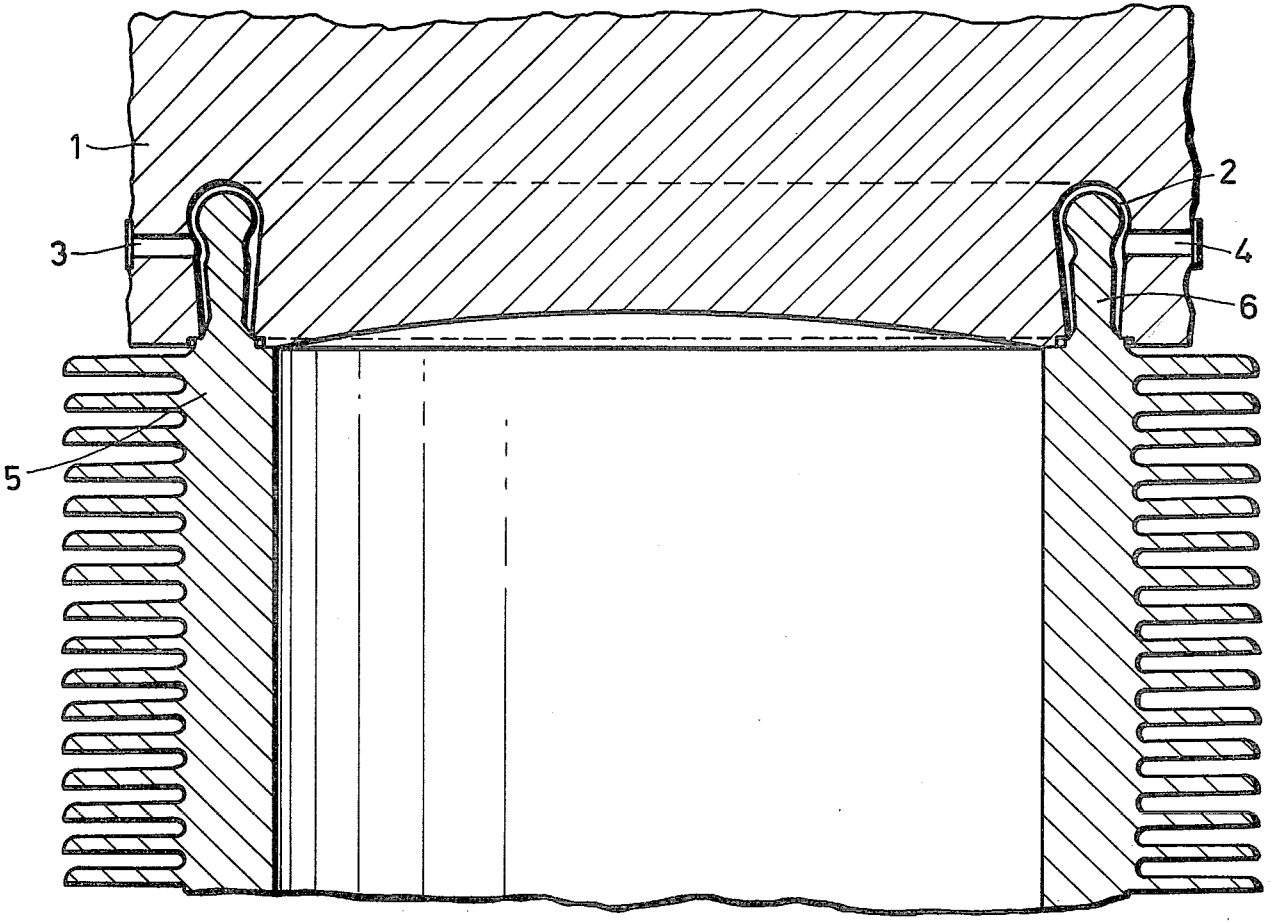
FIG. 1 shows one embodiment of a connection of a cylinder head and a cylinder barrel or tube, with the counterpiece, which engages in the groove, and the cylinder tube being made in one piece.

With the embodiment according to FIG. 1, the initial or prestressing forces can be distinctly reduced, since the seal or tightness between the cylinder head and the cylinder tube, which now form a unit, is already assured by the die cast connection.

Figure 2:
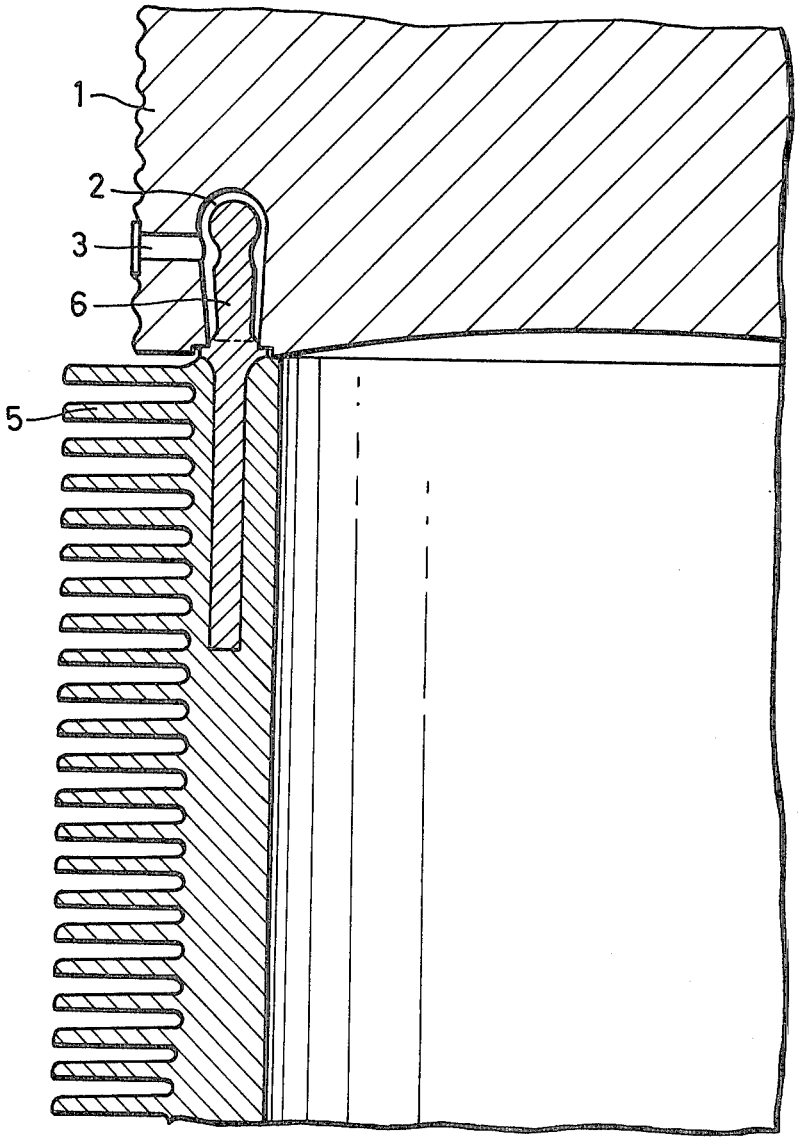
FIG. 2 shows another embodiment of a connection of a cylinder head and a cylinder tube, with the counterpiece which engages in the groove comprising a short steel tubing which is integrally cast into the cylinder tube.

With the embodiment according to FIG. 2, the strength of the upper part of the cylinder tube is additionally increased by the short steel support tubing cast into the cylinder tube.

The embodiment illustrated in FIG. 3 increases the strength in the region of the entire cylinder tube, and additionally makes it possible entirely to eliminate prestressing. Consequently, the otherwise conventional connecting rod screws can be eliminated, with short fastening screws at the base of the cylinder head—cylinder tube unit being sufficient. The danger of deformation of the cylinder tube is therefore extensively avoided.

The embodiment illustrated in FIG. 4 provides for an even better connection. In particular, one of the sidewalls of the groove 2 and of the counterpiece 6 are provided with respective grooving 7. It is, of course, also possible to provide both sidewalls of both the groove 2 and the counterpiece 6 with such grooving 7, or to only provide one or both sidewalls of only one of the groove 2 or the counterpiece 6 with such grooving 7. In place of the grooving 7, it would also be possible to provide the sidewall or sidewalls of at least one of the groove 2 and the counterpiece 6 with projections. A further possibility is to provide grooving in a sidewall or sidewalls of one of the groove 2 or the counterpiece 6, and corresponding projections on the sidewall or sidewalls of the other of the groove 2 or the counterpiece 6.

The present invention is, of course, in no way restricted to the specific disclosure of the specification and drawings, but also encompasses any modifications within the scope of the appended claims.

What I claim is:

1. A positive, gastight, undetachable die cast connection of two metal parts which form a unit with a seal tightness therebetween to reduce initial prestressing and deformation during subsequent treatment comprising a bulb-shaped groove in one of said two parts, and a bulb-shaped counterpiece associated with the other of said two parts, said groove having a base which is wider than its opening and said groove having inclined sidewalls which are further apart at the base of said groove than at the opening thereof, with the base of said groove being circular, said counterpiece having a head which is wider than its base and said counterpiece having inclined sidewalls which are further apart adjacent the head of said counterpiece than at the base thereof with an annular depression surface joining together its head and sidewalls, with the head of said counterpiece being circular, said counterpiece being inserted in said groove in such a way as to form an annular chamber therebetween, said annular chamber being filled with pouring of molten metal under pressure, said inclined sidewalls and circular head of said counterpiece assuring an occlusion-free pouring since sharp corners and edges are avoided on which dirt and gas bubbles can settle while eliminating cracks or fissures caused by sharp corners and edges, which occur under great mechanical and thermal loads acting thereon.

2. A connection according to claim 1, in which said two metal parts are a cylinder head and a cylinder tube respectively, with said groove being provided in said cylinder head, and said counterpiece comprising a tubing cast into said cylinder tube.

3. A connection according to claim 1, in which that metal part which is provided with said groove is also provided with at least one filling opening and at least one venting opening which respectively establish communication between said annular chamber and atmosphere.

4. A connection according to claim 3, in which said filling opening and said venting opening are diametrically arranged.

* * * * *